US006398653B1

(12) United States Patent
Chang

(10) Patent No.: US 6,398,653 B1
(45) Date of Patent: Jun. 4, 2002

(54) BATON STRUCTURE

(76) Inventor: Hung-yi Chang, No.336, Cheng-Kung Rd., Feng Yuan, Taichung Hsien (TW), 420

( * ) Notice: Subject to any disclaimer, the term of this patent is extended or adjusted under 35 U.S.C. 154(b) by 0 days.

(21) Appl. No.: 09/893,287

(22) Filed: Jun. 28, 2001

(51) Int. Cl.[7] ..... F41B 15/02

(52) U.S. Cl. ..... 463/47.6; 16/900; 403/84; 403/99; 403/101; 81/177.9

(58) Field of Search ..... 463/47.2, 47.4, 463/47.6; 403/83, 84, 85, 99, 101, 102, 150, 151, 161; 135/74, 143, 144, 145, 146; 16/900; 81/177.6, 177.7, 177.75, 177.9

(56) References Cited

U.S. PATENT DOCUMENTS 1,737,275 A * 11/1929 Sudek
5,085,433 A * 2/1992 Parsons
5,160,140 A * 11/1992 Starrett
6,131,971 A * 10/2000 Chen
6,216,317 B1 * 4/2001 Chen

* cited by examiner

*Primary Examiner*—William M. Pierce
(74) *Attorney, Agent, or Firm*—Rosenberg, Klein & Lee

(57) ABSTRACT

A baton structure is provided. The baton structure includes a knocking cylinder and a hollow connecting tube integrally extending from a surface of the knocking cylinder. A handle is pivotably mounted to the hollow connecting tube so that the handle is foldable to reduce the storage volume of the baton structure.

6 Claims, 7 Drawing Sheets

BATON STRUCTURE

BACKGROUND OF THE INVENTION

1. Field of the Invention

The present invention relates to a baton structure and more particularly, to a baton structure having a foldable handle to reduce the storage volume.

2. Description of the Related Prior Art

As shown in FIG. 7, a baton 6 includes a main rod 61, a hollow connecting tube 62 and a handle 63. The hollow connecting tube 62 integrally protrudes from one surface of the main rod 61 and the handle 63 is fixed to the hollow connecting tube 62. A disadvantage of such a prior art baton consists in large storage volume during packaging or transporting.

An expandable baton with spring biased latch means is disclosed in U.S. Pat. No. 5, 160, 140. The expandable baton includes a hollow cylindrical frame and a shaft sildably received in the cylindrical frame. A spring biased nylon steel pin assembly is further provided to limit contraction and extension of the shaft. A side handle can be fixed to the sleeve by a threaded screw. Thus, the handle of the conventional baton is not foldable. The storage volume of it can not be reduced.

SUMMARY OF THE INVENTION

However, it is found a disadvantage in the baton structure of the above-mentioned prior art that the handle is not foldable.

Thus, there is still a need for improving the baton structure of prior art in terms of providing a baton structure with a foldable handle.

Therefore, an object of the present invention is to provide a baton structure with a foldable handle to reduce the storage volume.

To accomplish the object of the present invention, a baton structure includes a knocking cylinder and a hollow connecting tube integrally extending from a surface of the knocking cylinder. The hollow connecting tube includes a free end, a slot formed at the free end to form two crevices and two walls, a slot edge formed at an edge of each crevice, a first aperture defined on a position near the knocking cylinder and related to one of the crevices, and a second aperture defined on each wall of the slot to allow a bolt to pass. The handle is pivotably mounted to the hollow connecting tube. The handle includes a holding portion having a connecting portion extending therefrom to correspond to the slot of the connecting tube. The connecting portion includes a protruding portion extending from an end thereof to correspond to the connecting tube, two long holes each defined on a side extending from the connecting portion to the protruding portion to allow the bolt to pass, a first opening defined to correspond to the first aperture of the connecting tube, and a first button partially protruding out of the first opening and biased by a spring to allow the first button to perpetually and partially protrude out of the first opening.

BRIEF DESCRIPTION OF THE DRAWINGS

The other advantages and/or benefits caused by the present invention will become patently apparent after reading the following detailed description of an illustrative preferred embodiment of the invention together with referring to the associated drawings in which.

DETAILED DESCRIPTION OF THE PREFERRED EMBODIMENT

Figure 1:
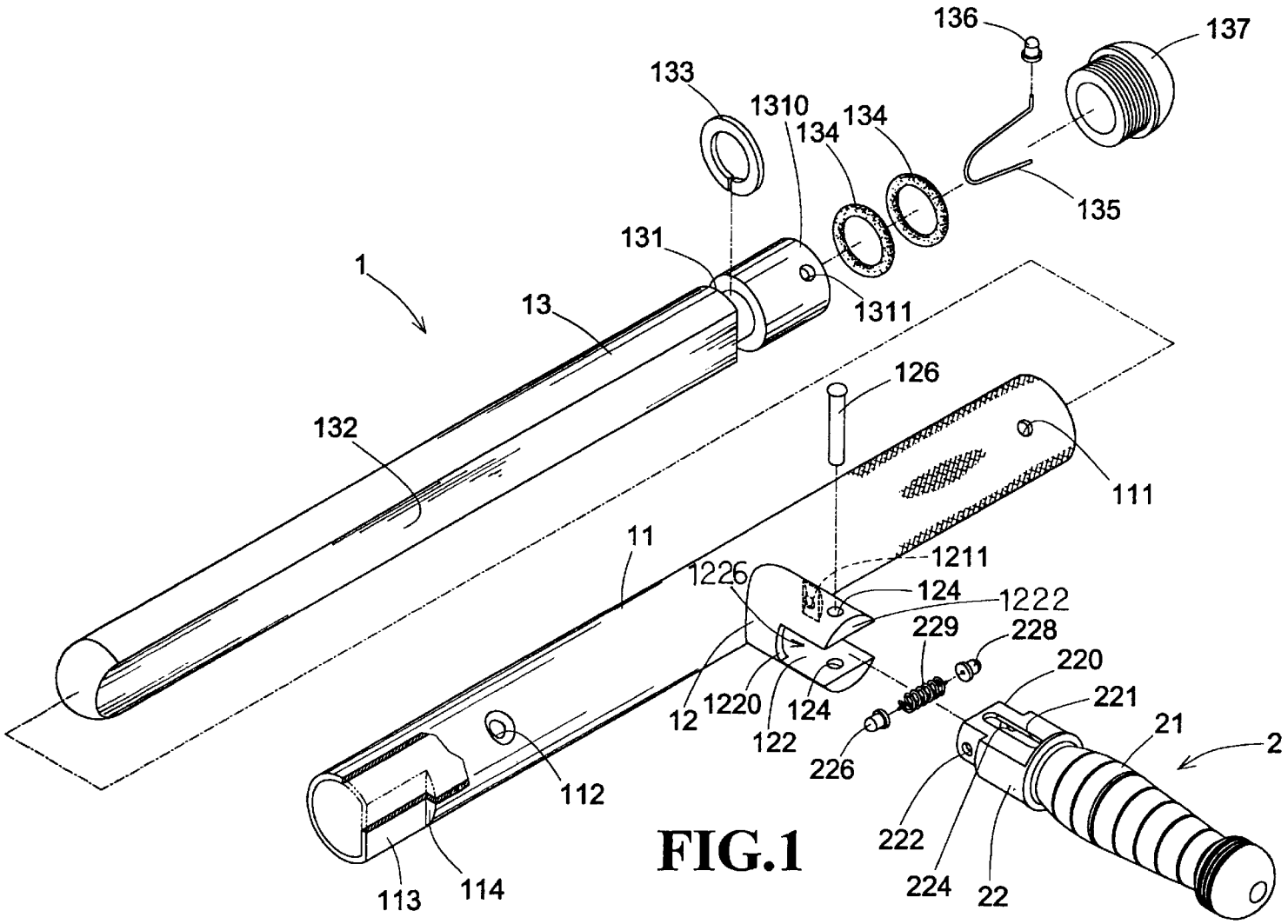
FIG. 1 is an exploded view of a baton structure in accordance with the present invention.

With reference to FIG. 1, a preferred embodiment of a baton structure in accordance with the present invention includes a main rod 1 and a handle 2. The handle 2 is foldably mounted to the main rod 1.

The main rod 1 is for defense and offense. The main rod 1 includes a knocking cylinder 11 and a hollow connecting tube 12. The hollow connecting tube 12 integrally extends from a surface of the knocking cylinder 1.

Figure 2:
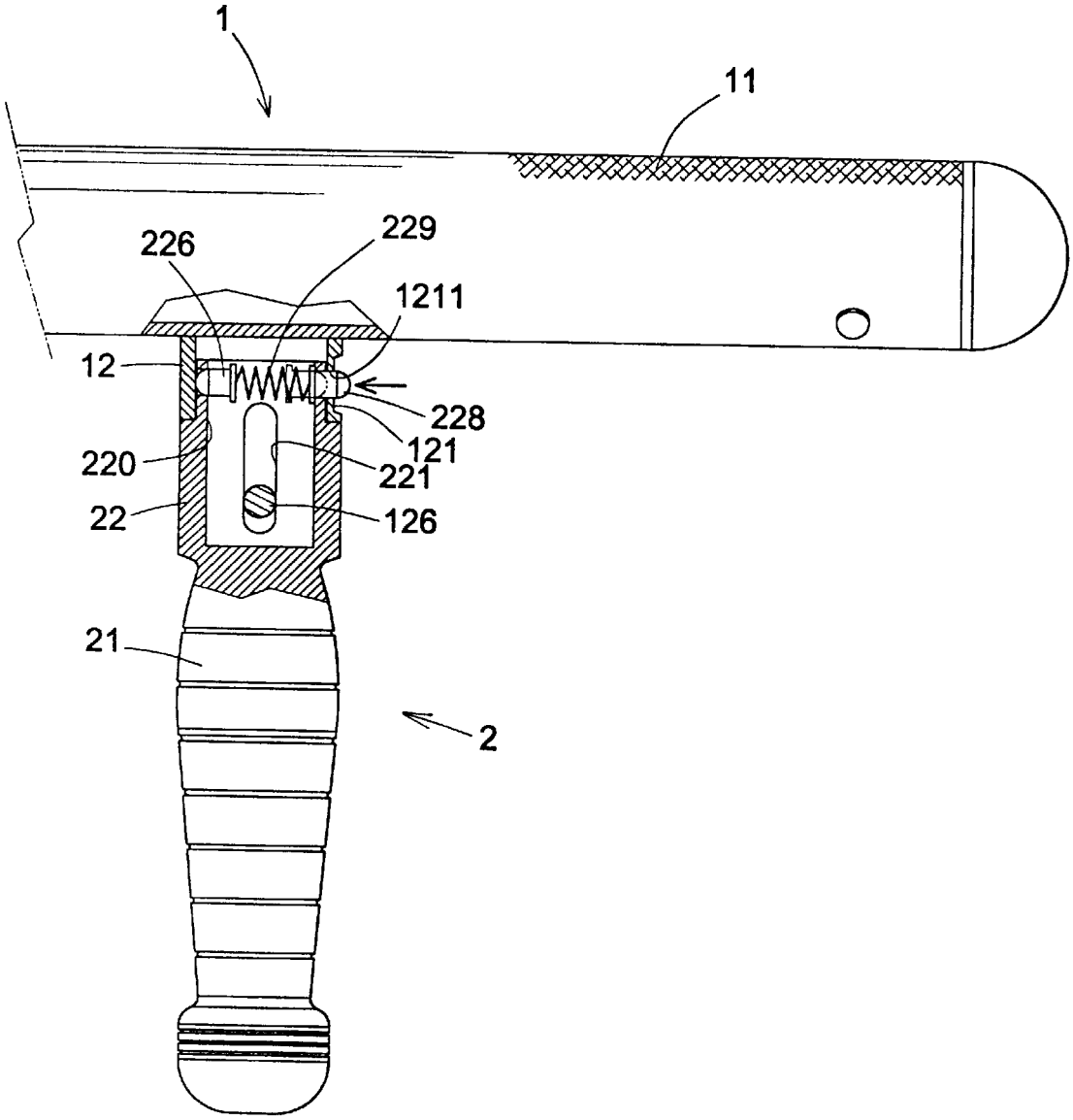
FIG. 2 is a partially side section view of the handle of the baton structure of FIG. 1.

With reference to FIGS. 1 and 2, the hollow connecting tube 12 includes a free end opposite to the end connected to the knocking cylinder 11, a slot 122, a slot edge 1220, a first aperture 1211, and second apertures 124.

The free end locates opposite to the surface of the knocking cylinder 11 where the connecting tube 12 extends. The slot 122 is formed at the free end to form two crevices 1226 and two walls 1222. The slot edge 1220 is formed at an edge of each crevice 1226. The first aperture 1211 is defined on a position near the knocking cylinder 11 and related to one of the crevices 1226. Each second aperture 124 is defined on each wall 1222 of the slot 122 to allow a bolt 126 to pass therethrough.

Preferredly, the connecting tube 12 includes a recess 121 (see FIG. 2) defined near the knocking cylinder 11 and the first aperture 1211 is defined in the recess 121.

The handle 2 is for folding and is pivotably mounted to the hollow connecting tube 12. The handle 2 includes a holding portion 21. On one end of the holding portion 21, a connecting portion 22 extends to correspond to the slot 122 of the connecting tube 12. Thus, the connecting portion 22 can be inserted into the slot 122 of the connecting tube 12.

The holding portion 21 is for holding with hands.

The connecting portion 22 includes a protruding portion 220, two long holes 221, a first opening 224, and a first button 228.

The protruding portion 220 extends from an end of the connecting portion 22 to correspond to the connecting tube 12. Thus, the protruding portion 220 can be inserted into the connecting tube 12.

Two long holes 221 are respectively defined on a side extending from the connecting portion 22 to the protruding portion 220. The long holes 221 are so configure that the bolt 126 can pass through the two long holes 221. Therefore, when the connecting portion 22 and protruding portion 220 are respectively inserted into the slot 122 and the connecting tube 12, the bolt 126 can be pass through the second apertures 124 and long holes 221 to pivotally mount the handle 2 to the connecting tube 12. Thus, the handle 2 is povitoally mounted to the main rod 1.

The first opening 224 is defined to correspond to the first aperture 1211 of the connecting tube 12. The first button 228 partially protrudes out of the first opening 224 and biased by a spring 229 to allow the first button 228 to perpetually and partially protrude out of the first opening 224. Therefore, the first button 228 can partially protrude out of the first aperture 1211 through the first opening 224 to lock the protruding portion 220 to the connecting tube 12. As shown in FIG. 2, the handle 2 is vertically lock to the main rod 1 to integrally show a T like side view.

Preferredly, the protruding portion 220 includes a second opening 222 defined on a side thereof opposite to the side having the first opening 224 defined thereon and a second button 226 partially protrudes out of the second opening 222 so that the spring 229 is urged between the first and the second buttons 228, 226.

Figure 3:
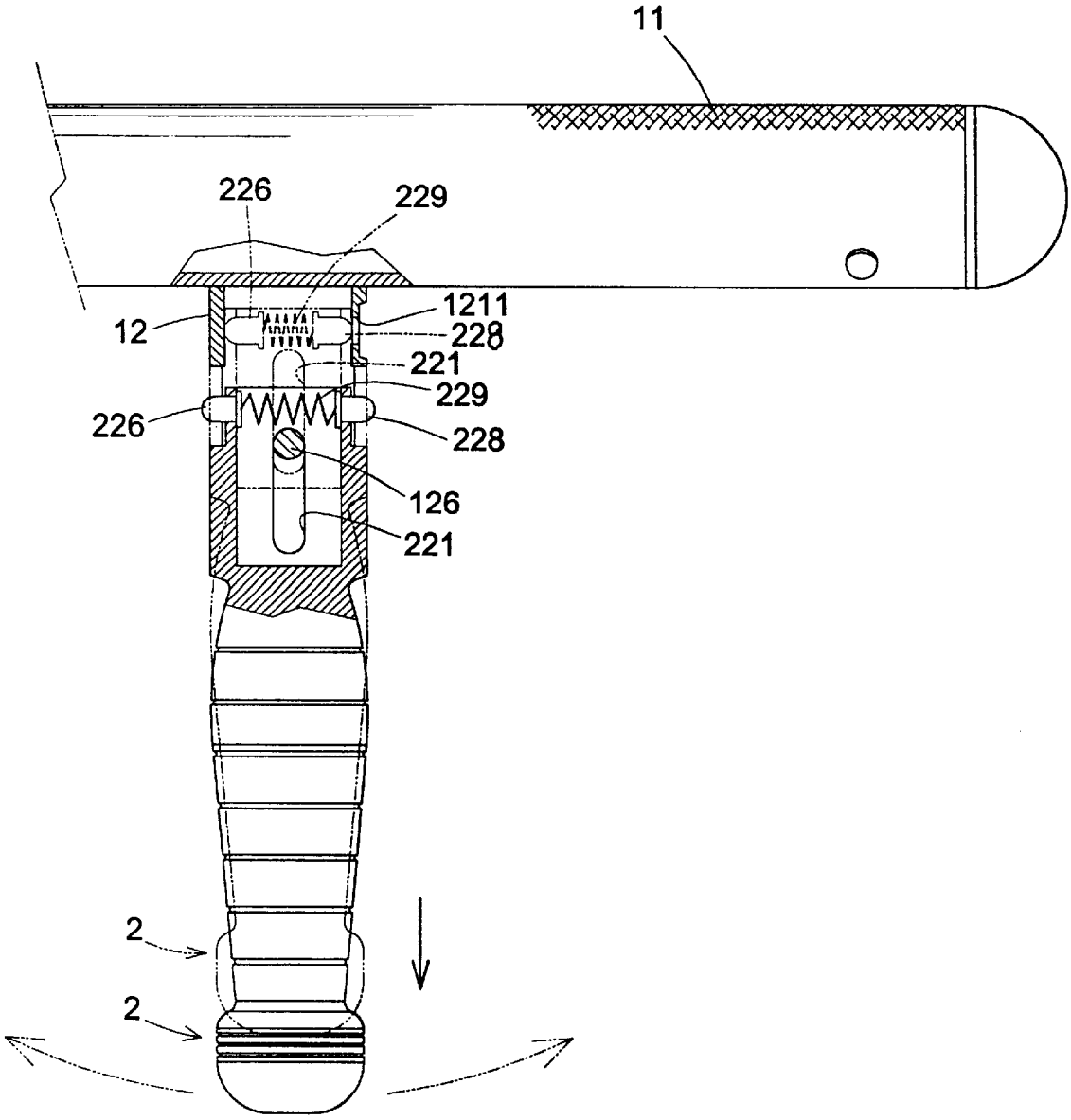
FIG. 3 is a schematic view showing the first step to fold the handle of the baton structure of FIG. 1.

With reference to FIGS. 2 and 3, when one desires to unlock the handle 2 from the main rod 1, he begins with hitting the first button 228 into the first aperture 1211 in the direction of the arrow (as shown in FIG. 2). Afterward, he pulls the handle 2 in the direction opposite to the main rod 1 so that the holding portion 21 can move downward (as shown by the arrow of FIG. 3). Thus, the first button 228 of the protruding portion 220 can be pulled out of the first aperture 1221 of the connecting tube 12 to unlock the handle 2. Then, handle 2 can freely swing clockwise or anti-clockwise related to the bolt 126 serving as the axis for its swinging (as shown by the dotted arrows of FIG. 3).

Figure 4:
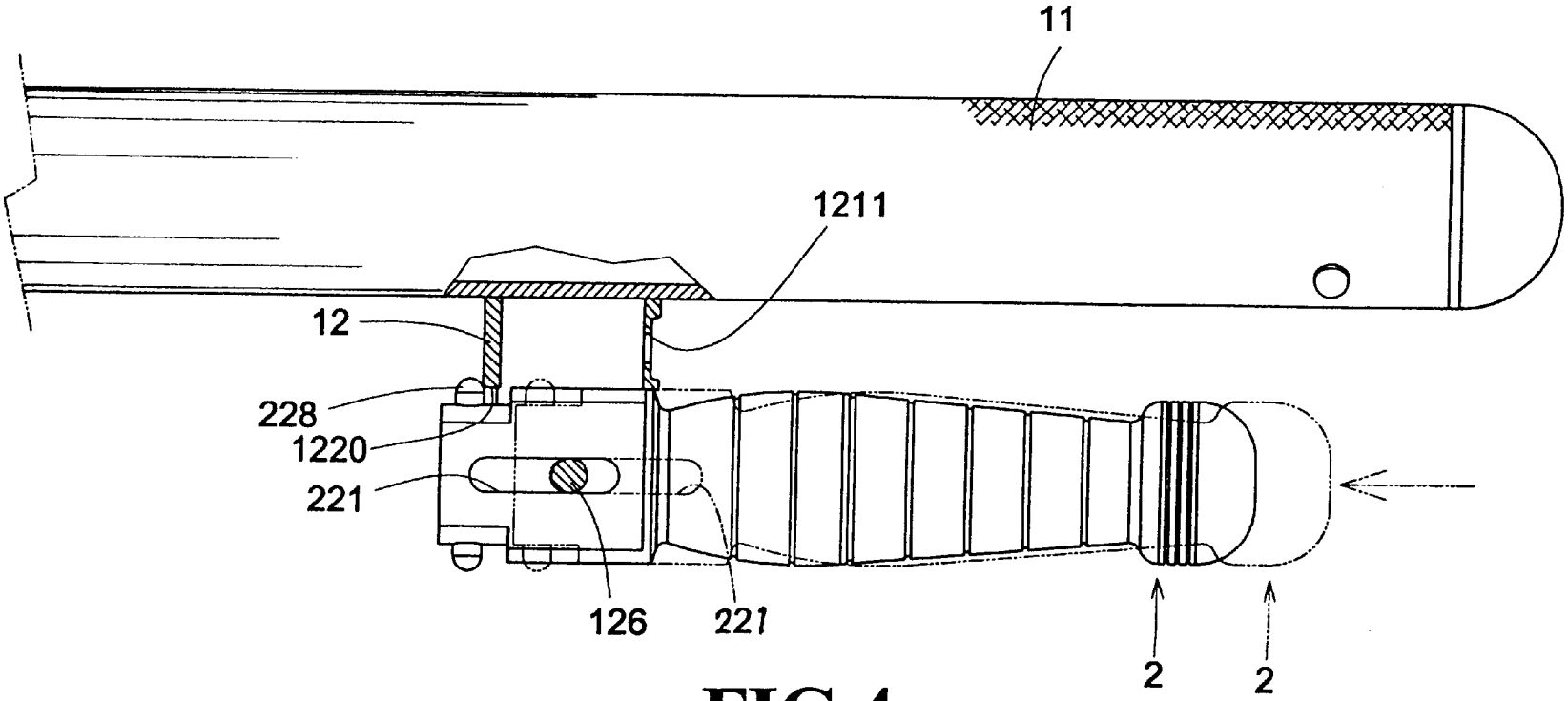
FIG. 4 is a schematic view showing the subsequent step to fold the handle of the baton structure of FIG. 1.

With reference to FIG. 4, when the handle 2 swings anti-clockwise to a horizontal position, the handle 2 can further be moved in the direction indicated by the dotted arrow. Meanwhile, the first button 228 is moved to be locked the slot edge 1220 of the connecting tube 12. Thus, the handle 2 is folded to a position that it is longitudinally parallel to the knocking cylinder 11.

Figure 5:
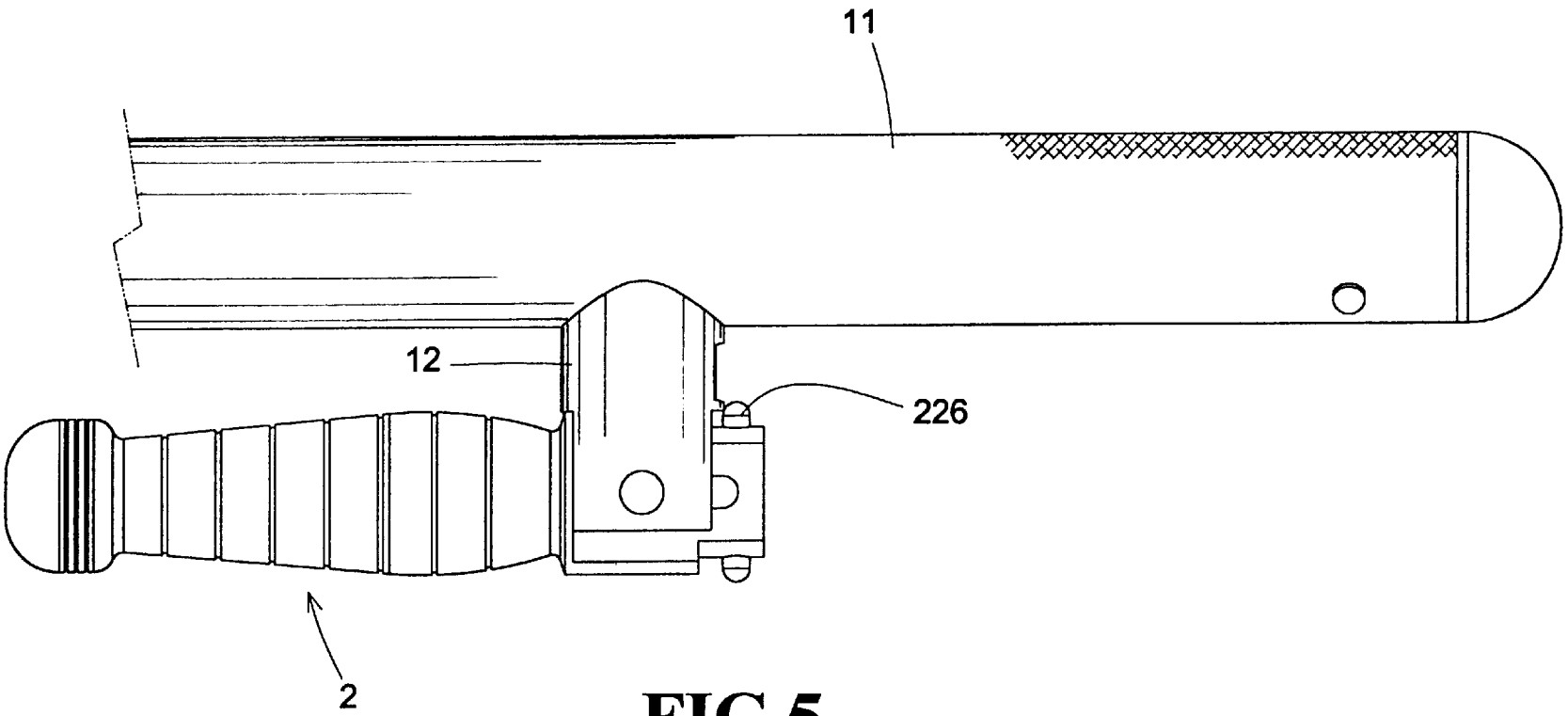
FIG. 5 is a schematic view showing the other subsequent step to fold the handle of the baton structure of FIG. 1.

With reference to FIG. 5, when the handle 2 swings to a horizontal position, similarly, the handle 2 can be locked by the second button 226 to form a folded state. This folded state is the other embodiment of the present invention.

Figure 6:
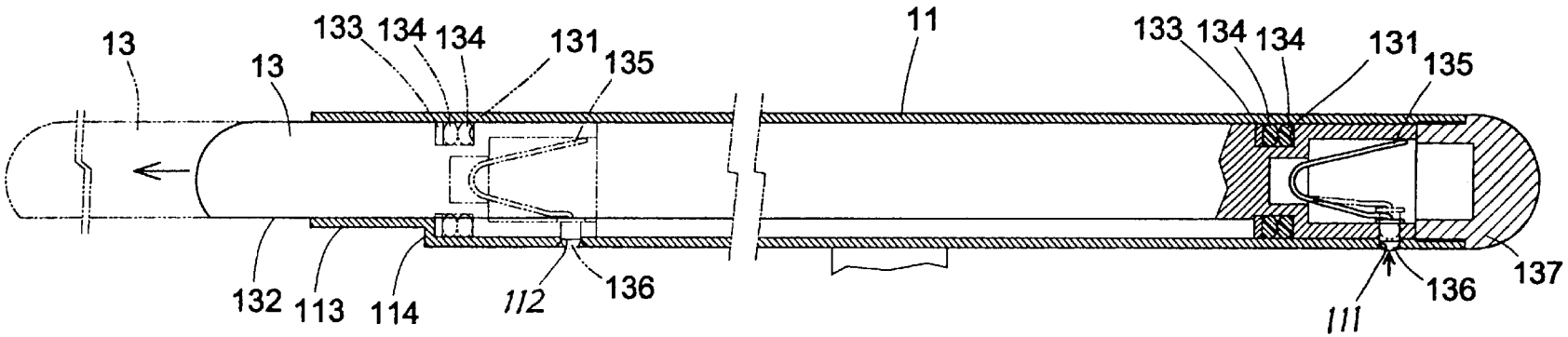
FIG. 6 is a partially side section view of the knocking cylinder of the baton structure of FIG. 1.
Figure 7:
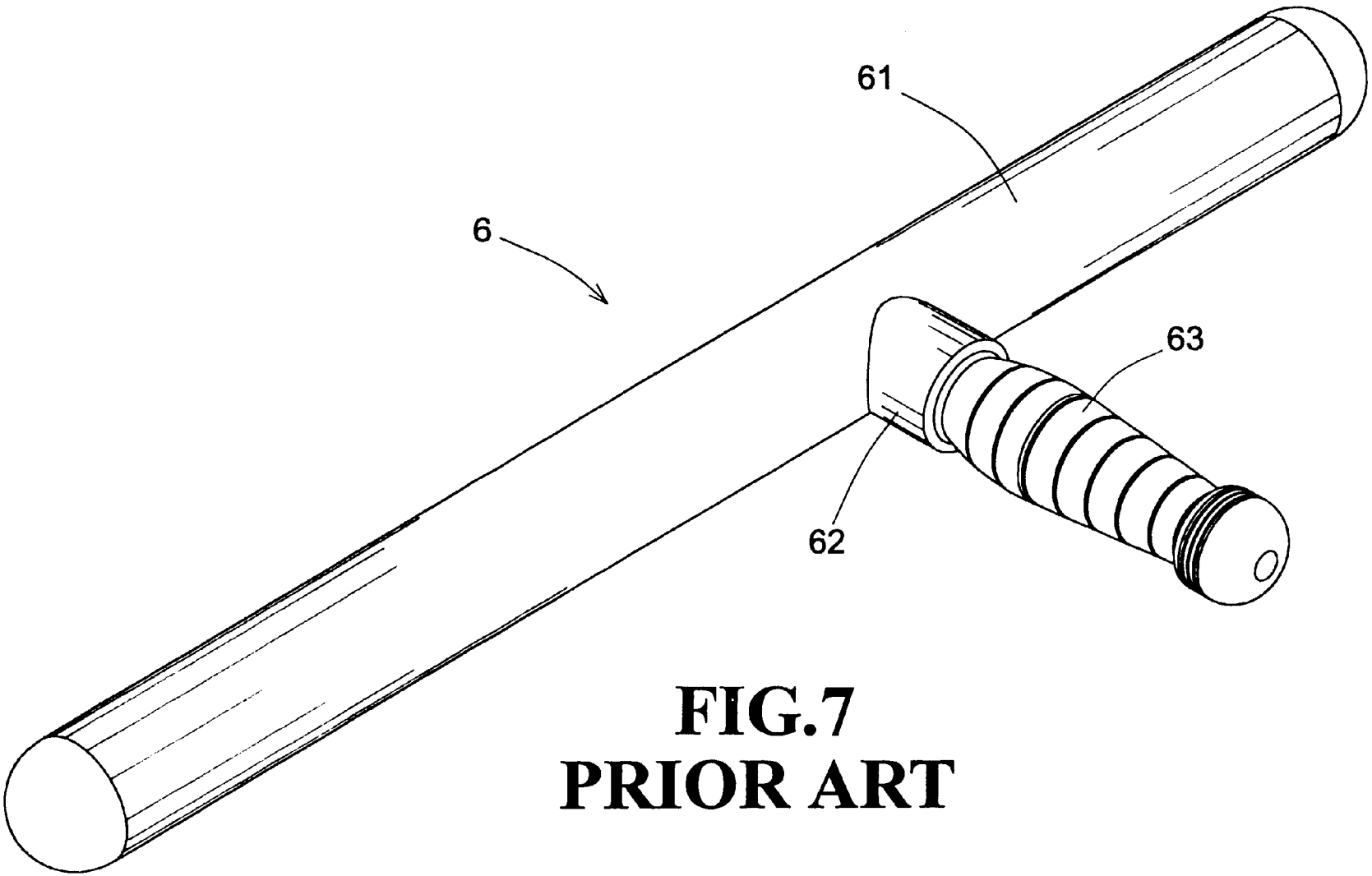
FIG.7 PRIOR ART
FIG. 7 is a perspective view of a prior art baton.

With reference to FIGS. 1 and 6, the knocking cylinder 11 preferredly is hollow. The knocking cylinder 11 includes a first plain portion 113, a block portion 114, a fourth aperture 112, a third aperture 111, and an inner shaft 13 received therein.

The first plain portion 113 integrally extends from a position to an end of the knocking cylinder 11. The block portion 114 is located at the position where the first plain portion 113 begins to extend toward the end of the knocking cylinder 11. The fourth aperture 112 is defined at an end near the block portion 114. The third aperture 111 is defined at an end opposite to the block portion 114.

The inner shaft 13 is slidably received in the knocking cylinder 11 and its contraction and extension from the knocking cylinder 11 can be limited. It is explained in following paragraphs.

The inner shaft 13 includes a second plain portion 132, a hollow tube 1310, and a circular recess 131.

The second plain portion 132 is defined to correspond to the first plain portion 113 of the knocking cylinder 11. Thus, a relative rotation between the inner shaft 13 and the knocking cylinder 11 is eliminated by the match of the first and the second plain portions 113, 132 when the inner shaft 13 is received in knocking cylinder 11.

The hollow tube 1310 is defined opposite to the second plain portion 132. The hollow tube 1310 has a fifth aperture 1311 so configured to correspond to the third aperture 111 of the knocking cylinder 11. A third button 136 is provided to partially and elastically protrude out of the third aperture 111 through the fifth aperture 1311 by a spring 135. The third button 136 together with the spring 135, thus, can lock the inner shaft 13 on the knocking cylinder 11 when the inner shaft 13 is received in the knocking cylinder 11.

The circular recess is defined between the second plain portion 132 and the hollow tube 1310.

When one hits the third button 136 into the third aperture 111 to unlock the inner shaft 13 from the knocking cylinder 11 so as to allow an extension of the inner shaft 13 from the knocking cylinder 11 (as shown by the arrow of FIG. 6), the extension distance is decided by the distance between the first aperture 111 and the fourth aperture 112. The block portion 114 of the knocking cylinder 11 can stop the extending of the inner shaft 13 by block the circular recess 131 of the inner shaft 13. After extending, the third button 136 partially protrudes out of the fourth aperture 112 through the fifth aperture 1311 so that the inner shaft 13 can be locked by the knocking cylinder 11.

Preferredly, a C ring 133 and two O rings 134 are provided to encircle the circular recess 131. The assembly of the C ring 133 and O rings 134 will damp the colliding force between the block portion 114 and the circular recess 131.

More preferredly, the knocking cylinder 11 includes a cap 137 mounted at an end to correspond to the hollow tube 131 of the inner shaft 13. The cap 137 can prevent the inner shaft 13 from dropping out of the knocking cylinder 11.

Having thus detailedly described the preferred embodiment of the present invention, it will become apparently to those skilled in the art that the detailed description of the preferred embodiment of the present invention is illustrative only and thus various modifications, changes and substitutions can be made without departing from the spirit of the following claims of the present invention. All of such modifications, changes and substitution as stated above are still within the scope of the present invention.

What is claimed is:

1. A baton structure comprising a main rod including a knocking cylinder and a hollow connecting tube integrally extending from a surface of the knocking cylinder, the hollow connecting tube including a free end opposite to the surface of the knocking cylinder where connecting tube extends, a slot formed on the free end to form two crevices and two walls, a slot edge formed at an edge of each crevice, a first aperture defined on a position near the knocking cylinder and related to one of the crevices, and a second aperture defined on each wall of the slot to allow a bolt to pass therethrough, and a handle pivotably mounted to the hollow connecting tube, the handle including a holding portion having a connecting portion extending therefrom to correspond to the slot of the connecting tube, the connecting portion including a protruding portion extending from an end thereof to correspond to the connecting tube, two long holes each defined on a side extending from the connecting portion to the protruding portion to allow the bolt to pass therethrough, a first opening defined to correspond to the first aperture of the connecting tube, and a first button partially protruding out of the first opening and biased by a spring to allow the first button to perpetually and partially protrude out of the first opening.

2. The baton structure as claimed in claim 1, wherein the connecting tube further includes a recess defined near the knocking cylinder and the first aperture is defined in the recess.

3. The baton structure as claimed in claim 1, wherein the protruding portion further includes a second opening defined on a side thereof opposite to the side having the first opening defined thereon and a second button partially protrudes out of the second opening so that the spring is urged between the first and the second buttons.

4. The baton structure as claimed in claim 1, wherein the knocking cylinder is hollow and includes a first plain portion integrally extending from a position to an end thereof, a block portion located at the position the first plain portion extending, a fourth aperture defined on an end near the block portion, a third aperture defined on an end opposite to the end the block portion defined, and an inner shaft slidably received therein, the inner shaft including a second plain portion corresponding to the first plain portion of the knocking cylinder, a hollow tube defined opposite to the second plain portion, the hollow tube having a fifth aperture corresponding to the third aperture of the knocking cylinder to allow a third button partially and elastically protruding out of the fifth aperture by a spring, and a circular recess defined between the second plain portion and the hollow tube.

5. The baton structure as claimed in claim 4, wherein a C ring and an O ring are further provided to encircle the circular recess.

6. The baton structure as claimed in claim 4, wherein the knocking cylinder further includes a cap mounted on an end corresponding to the hollow tube.

* * * * *